US008424245B1

(12) United States Patent
Kunz et al.

(10) Patent No.: US 8,424,245 B1
(45) Date of Patent: Apr. 23, 2013

(54) WINDOW CONSTRUCTION UTILIZING SASH SPACER ASSEMBLIES

(76) Inventors: John R. Kunz, Douglassville, PA (US); Fred D. Kershaw, Lansdale, PA (US)

( * ) Notice: Subject to any disclaimer, the term of this patent is extended or adjusted under 35 U.S.C. 154(b) by 683 days.

(21) Appl. No.: 12/574,692

(22) Filed: Oct. 6, 2009

(51) Int. Cl.
*E05D 15/22* (2006.01)

(52) U.S. Cl.
USPC ..... 49/185; 49/183; 49/62

(58) Field of Classification Search ..... 49/183, 49/184, 185, 176, 179, 181, 449, 61, 62, 49/63, 125; 292/80, 1, DIG. 38, DIG. 60, 292/DIG. 63, DIG. 37
See application file for complete search history.

(56) References Cited

U.S. PATENT DOCUMENTS 729,885 A * 6/1903 McSherry ..... 160/98
2,356,427 A * 8/1944 Pressnall ..... 292/204
4,623,177 A * 11/1986 McKinney ..... 292/87
5,301,989 A * 4/1994 Dallmann et al. ..... 292/142
2005/0144845 A1* 7/2005 Heck et al. ..... 49/185
2009/0223130 A2* 9/2009 Ozawa ..... 49/185

* cited by examiner

*Primary Examiner* — Gregory J. Strimbu
(74) *Attorney, Agent, or Firm* — LaMorte & Associates, P.C.

(57) ABSTRACT

A window sash installed into a window frame, wherein the window sash assumes an operable position where the vertical sides of the window sash are aligned with the side jambs of the window frame. A gap space exists between each of the vertical sides of the window sash and the side jambs of the window frame. This gap space is utilized by a counterbalance system. Spacer assemblies are attached to the window sash. Each spacer assembly has a base that mounts to the window sash and a slide that selectively extends from the base. The slides are extended across the gap spaces between the sash and the side jambs. The slides are brought into close proximity with the side jambs. The presence of the slides prevents the window sash from being able to cock out of the intended operational orientation of the window sash.

9 Claims, 6 Drawing Sheets

WINDOW CONSTRUCTION UTILIZING SASH SPACER ASSEMBLIES

BACKGROUND OF THE INVENTION

1. Field of the Invention

The present invention relates to the construction of single-hung and double-hung windows. More particularly, the present invention relates to windows having components mounted on a window sash for preventing a window sash from cocking or wobbling in the window frame.

2. Prior Art Description

There are many types of windows used in modern construction. Some windows are designed to open, some are not. Of the windows that are designed to open, some windows have sashes that open vertically and others have sashes that slide open laterally, or rotate outwardly.

Windows that have vertically opening sashes are the most common window used in residential home construction. Vertically opening windows are either single-hung, having one sash that opens, or double-hung, having two sashes that open. In both single-hung and double-hung windows, a counterbalance system is used to hold a window sash up once it is opened. If no counterbalance system is used, gravity causes the sash of the window to close as soon as it is opened and released.

Counterbalance systems for single-hung and double-hung windows typically use coil springs to counterbalance the weight of the window sashes. The presence of a counterbalance system requires that a substantial space be left between the sash of the window and the jambs of the window frame. The counterbalance system operates in this space. The counterbalance system is protected from view and from contact by using extruded window frame jambs that are generally U-shaped in cross section. The counterbalance system sits within the center of the groove defined by this track and is thus protected from sight.

When a window is manufactured, the sashes of the window are made separately from the frame of the window. The sashes are later assembled into the frame.

Due to variations in manufacturing tolerances, the length of a window sash may vary by up to $1/8^{th}$ of an inch. Likewise, the distance between jambs in a window frame may also vary by up to $1/8^{th}$ of an inch. As a consequence, if an undersized sash is assembled into an oversized window frame, there may be over ¼ inch of play between the sash and the tracks of the window frame.

If a window sash has too much play in a window frame, the window sash may cock in position when moved by a person or when influenced by the counterbalance system. Additionally, if the window sash cocks in position, a gap may be created between the window and the sill, thereby greatly reducing the insulation rating for that window.

A need therefore exists for a system that can be added in a window assembly, both at its time of manufacture and retroactively, that prevents the window sash from cocking. This need is met by the present invention as described and claimed below.

SUMMARY OF THE INVENTION

When a sash is installed into a window frame, it assumes an operable position where the vertical sides of the window sash are aligned with the side jambs of the window frame. When the sash is in its operational position, a gap space exists between each of the vertical sides of the window sash and the side jambs of the window frame. This gap space is utilized by the counterbalance system. However, this same gap space provides the room in the window assembly that may allow a window sash to cock in position.

Spacer assemblies are attached to the window sash. Each spacer assembly has a base that mounts to the window sash and a slide that selectively extends from the base. The slides are extended across the gap spaces between the sash and the side jambs. The slides are brought into contact or into close proximity with of the side jambs. The presence of the slides prevents the window sash from being able to cock out of its intended operational orientation.

BRIEF DESCRIPTION OF THE DRAWINGS

For a better understanding of the present invention, reference is made to the following description of exemplary embodiments thereof, considered in conjunction with the accompanying drawings, in which.

DETAILED DESCRIPTION OF THE DRAWINGS

Although the present invention window construction can be configured as a double-hung or single-hung window, the present invention window construction is especially useful when configured as a tilt-in window and side-load window, where the sashes can be selectively removed. The exemplary embodiment selected for illustration shows a side-load window sash in order to present one of the best modes contemplated for the invention and should not be considered a limitation upon the invention as claimed.

Figure 1:
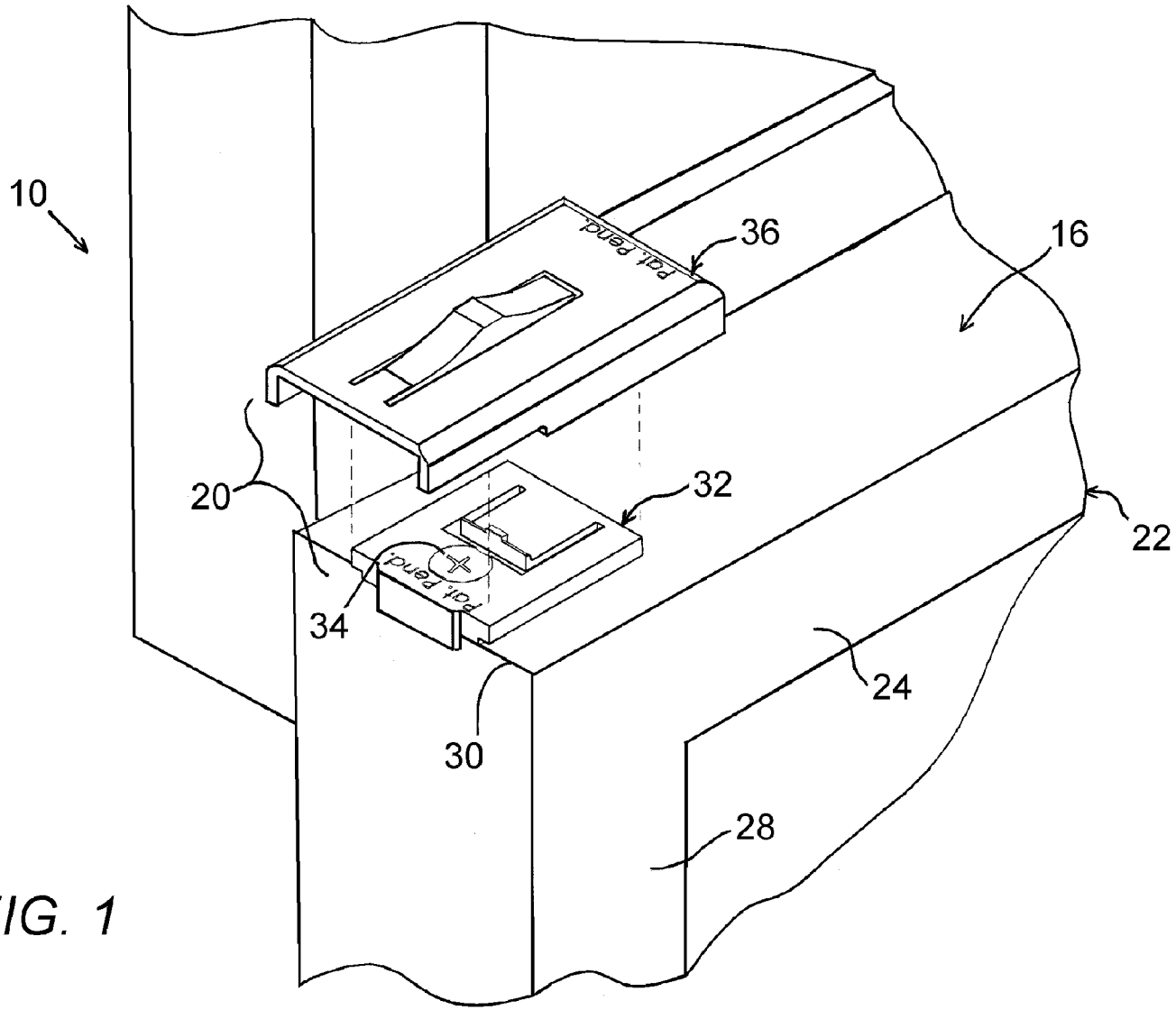
FIG. 1 is a fragmented perspective view of a window construction having spacer assemblies attached to a window sash.
Figure 2:
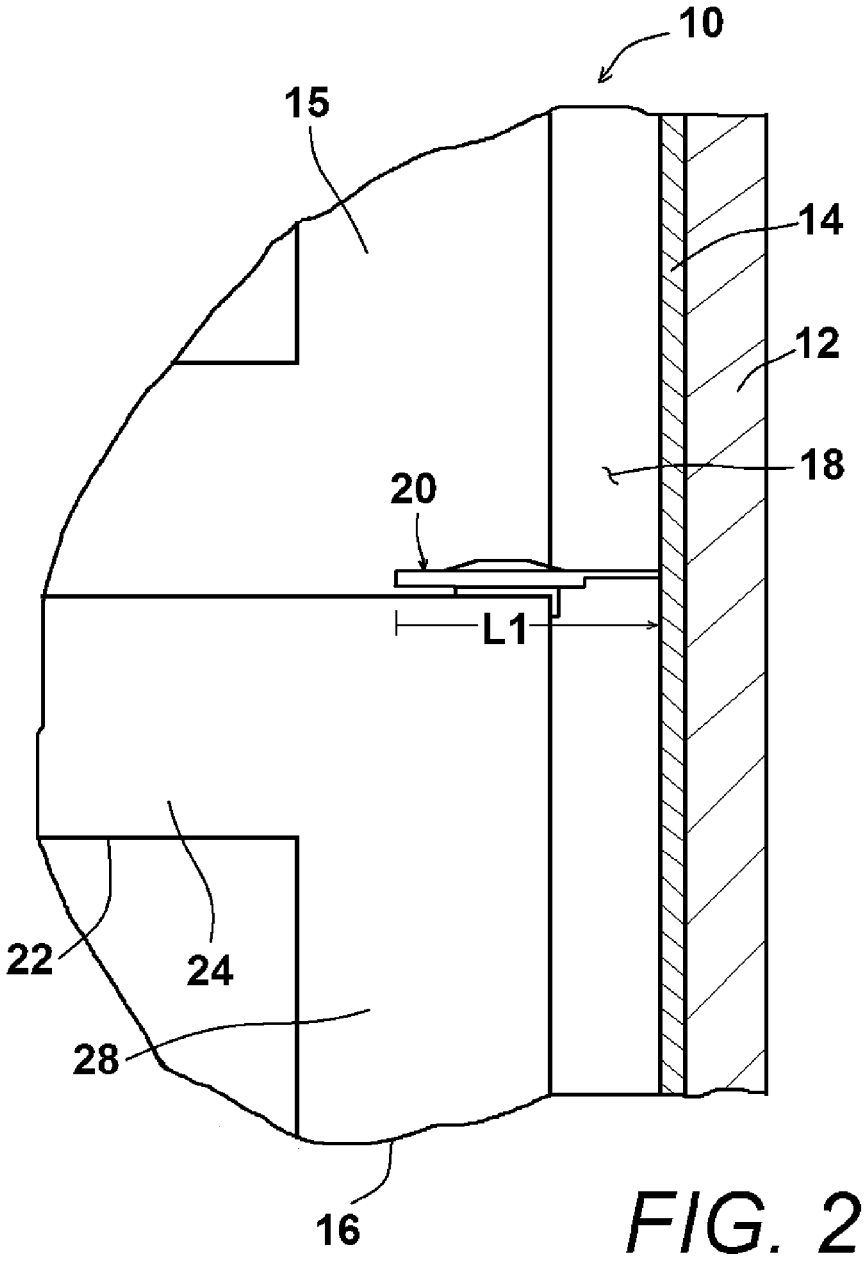
FIG. 2 is a fragmented side view of the window construction of FIG. 1, wherein portions of the window frame and window jamb are shown in cross-section.

Referring to both FIG. 1 and FIG. 2, there is shown a window assembly 10. The window assembly 10 has a window frame 12 with side jambs 14 that retain both an upper sash 15 and a lower sash 16. As has been previously stated, the window assembly 10 is preferably a side-load window, wherein at least the lower window sash 16 can be selectively removed from the window frame for cleaning or other purposes.

When the window sash 16 is loaded into the window frame 12, it enters its operable position. In its operable position, the window sash 16 can be selectively opened and closed by being slid up and down. To prevent the window sash 16 from closing under the force of its own weight, it must be counterbalanced. A counterbalance system (not shown) is provided to retain the window sash 16 in an open position. The counterbalance system is placed between the window sash 16 and the window frame side jambs 14. To accommodate the counterbalance system, a gap space 18 is provided between the lower sash 16 and the side jambs 14.

The present invention construction utilizes a spacer assembly 20 that is used to bring the sash 16 in contact with the side jambs 14 across the void of the gap space 18. The window sash 16 has a framework 22 defined by a top sash element 24, a bottom sash element (not shown) and two side sash elements 28. The side sash elements 28 meet opposite ends of the top sash element 24 at two top corners 30. The spacer assembly 20 attaches to the top sash element 24 at the two top corners 30. As will be explained, the spacer assembly 20 has two parts. A base 32 is anchored to the top sash element 24 using a screw 34 or similar fastener. A slide 36 attaches to the base 32 and selectively extends laterally from the base 32. The slide 36 causes the length L1 of the spacer assembly 20 to vary. In this manner, the spacer assembly 20 can be elongated until the end of the slide 36 comes into close proximity with the side jamb 14 of the window frame 12. The presence of the spacer assemblies 20 on either side of the sash 16 prevents the sash 16 from being able to cock to any substantial degree. Furthermore, the slide 36 on the spacer assemblies 20 can be retracted should a person ever want to tilt or remove the window sash 16.

Figure 3:
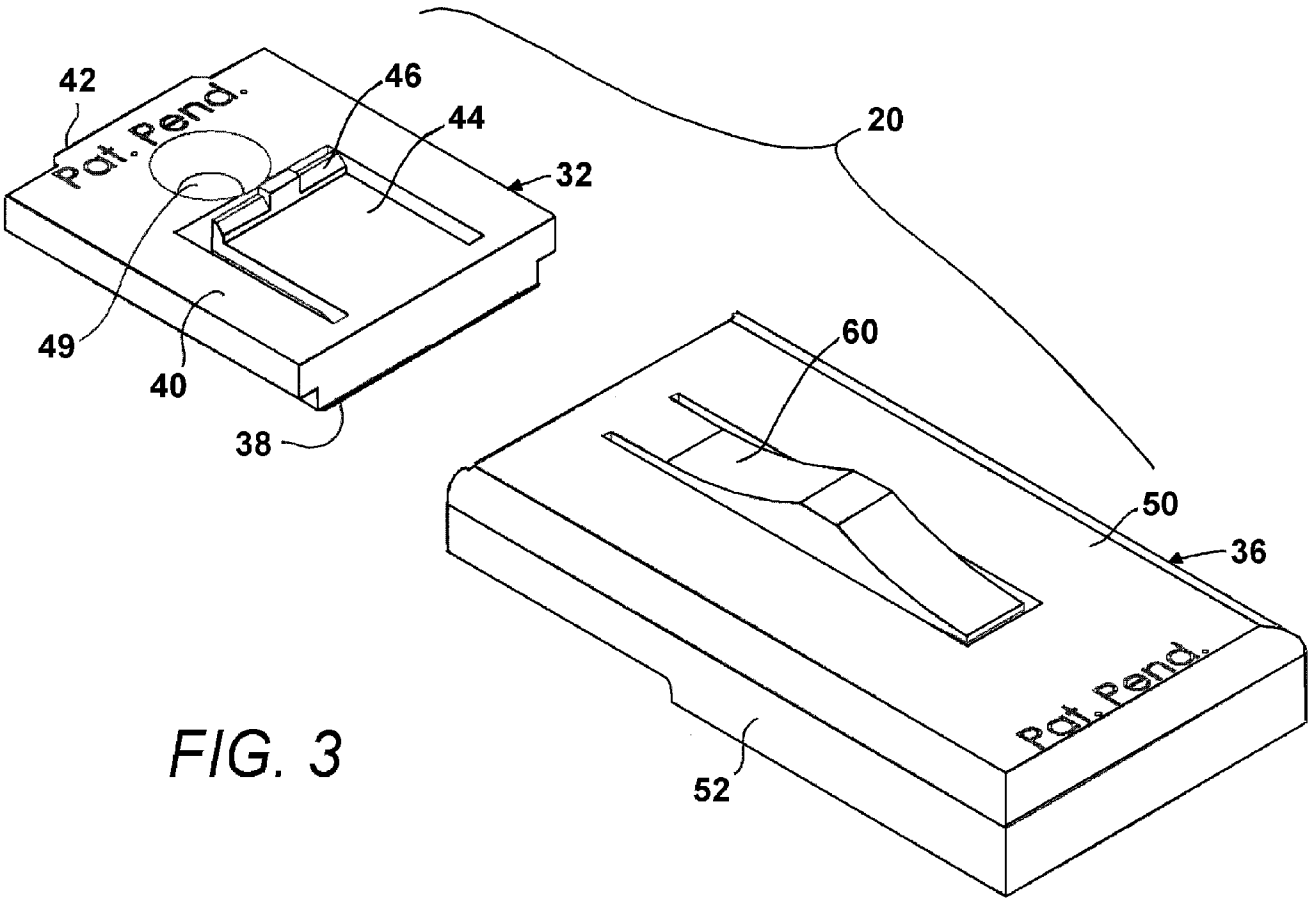
FIG. 3 is a top perspective view of a first embodiment of a spacer assembly.
Figure 4:
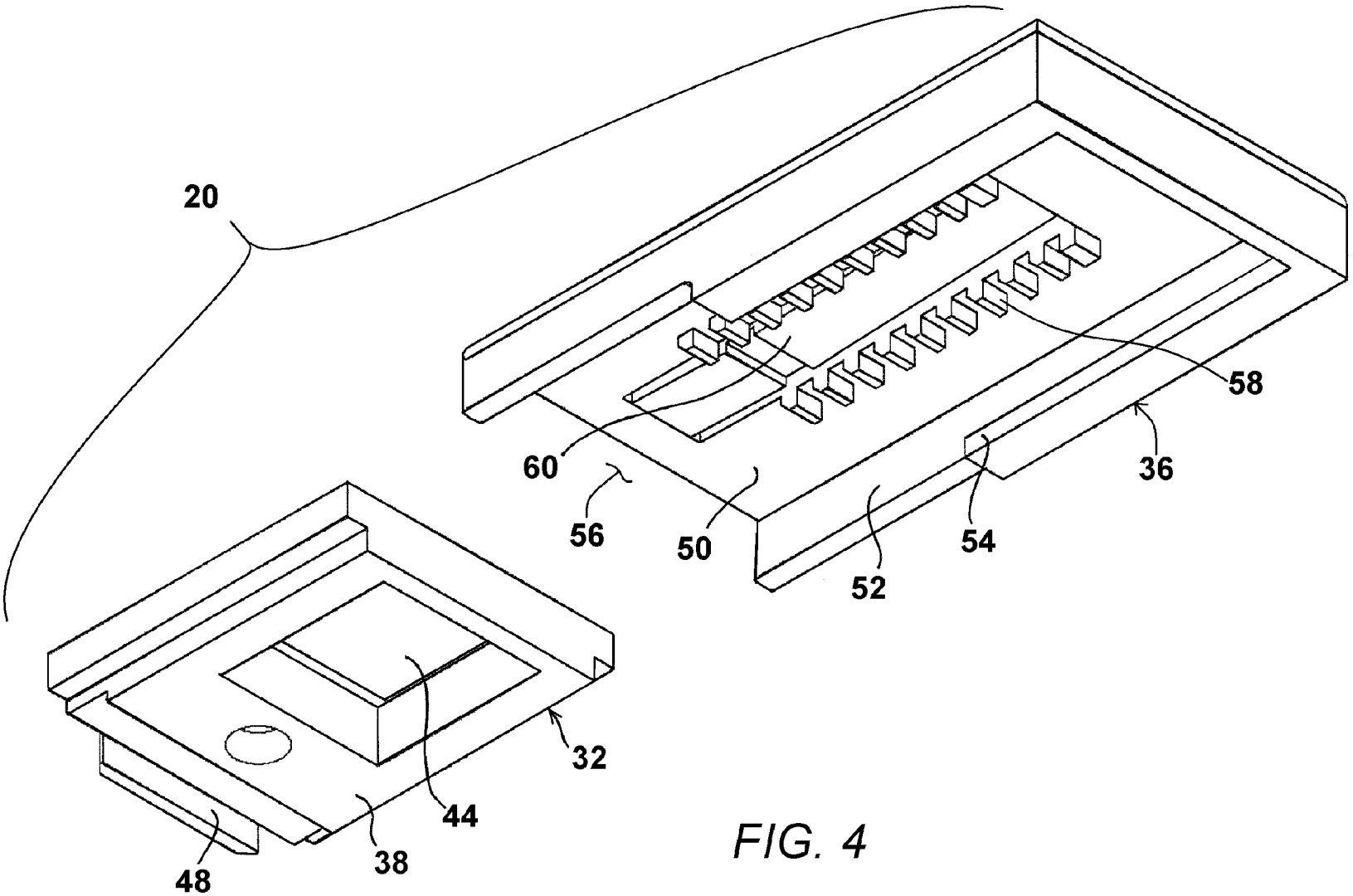
FIG. 4 is a bottom perspective view of the spacer assembly of FIG. 3.

Referring to FIGS. 3 and 4 in conjunction with FIG. 2, it can be seen that each spacer assembly 20 has two components, which include the base 32 and the slide 36. The base 32 has a bottom surface 38, a top surface 40 and a forward edge 42. The base 32 has a generally T-shaped cross-section. Accordingly, the top surface 40 is wider than the bottom surface 38.

A flexible finger 44 is formed in the base 32. The flexible finger 44 has a catch 46 that faces upwardly. That is, the catch 46 of the flexible finger 44 extends upwardly and terminates at an elevation above that of the top surface 40. However, due to the flexible nature of the flexible finger 44, the catch 46 can be depressed to the level of the top surface 40 with a small downward force.

A stop 48 is formed at the forward edge 42 of the base 32. The stop 48 extends downwardly from the base 32 and terminates at an elevation below the bottom surface 38 of the base 32. The stop 48 is used to orient the base 32 on a window sash 16. The base 32 is placed on the horizontal top sash element 24 near each top corner 30. The stop 48 extends down over the corner 30, thereby orienting the base 32 relative the corner 30. A screw hole 49 is formed through the base 32. Once the base 32 is properly oriented relative the corner 30, a screw 34 is driven through the base 32 and into the top sash element 24. This anchors the base 32 in a known set position on the top sash element 24.

The slide 36 is sized and configured to receive the base 32 and to slide laterally along the base 32. The slide 36 has a top plate 50. Peripheral walls 52 extend down from three edges of the top plate 50. Accordingly, one side of the slide 36 remains open. Portions of the peripheral walls 52 terminate with inwardly oriented lips 54. This causes the slide 36 to define a T-shaped slot 56 that can receive the base 32. Once the base 32 passes into the slide 36, the slide 36 is free to move laterally along the length of the slot 56, but all other movement is restricted.

Racks of teeth 58 are formed on the underside of the top plate 50. The racks of teeth 58 are uniform in size and pitch. The racks are aligned in parallel so that the racks of teeth 58 also align. A flexible press plate 60 extends through the top plate 50 between the racks of teeth 58.

Figure 5:
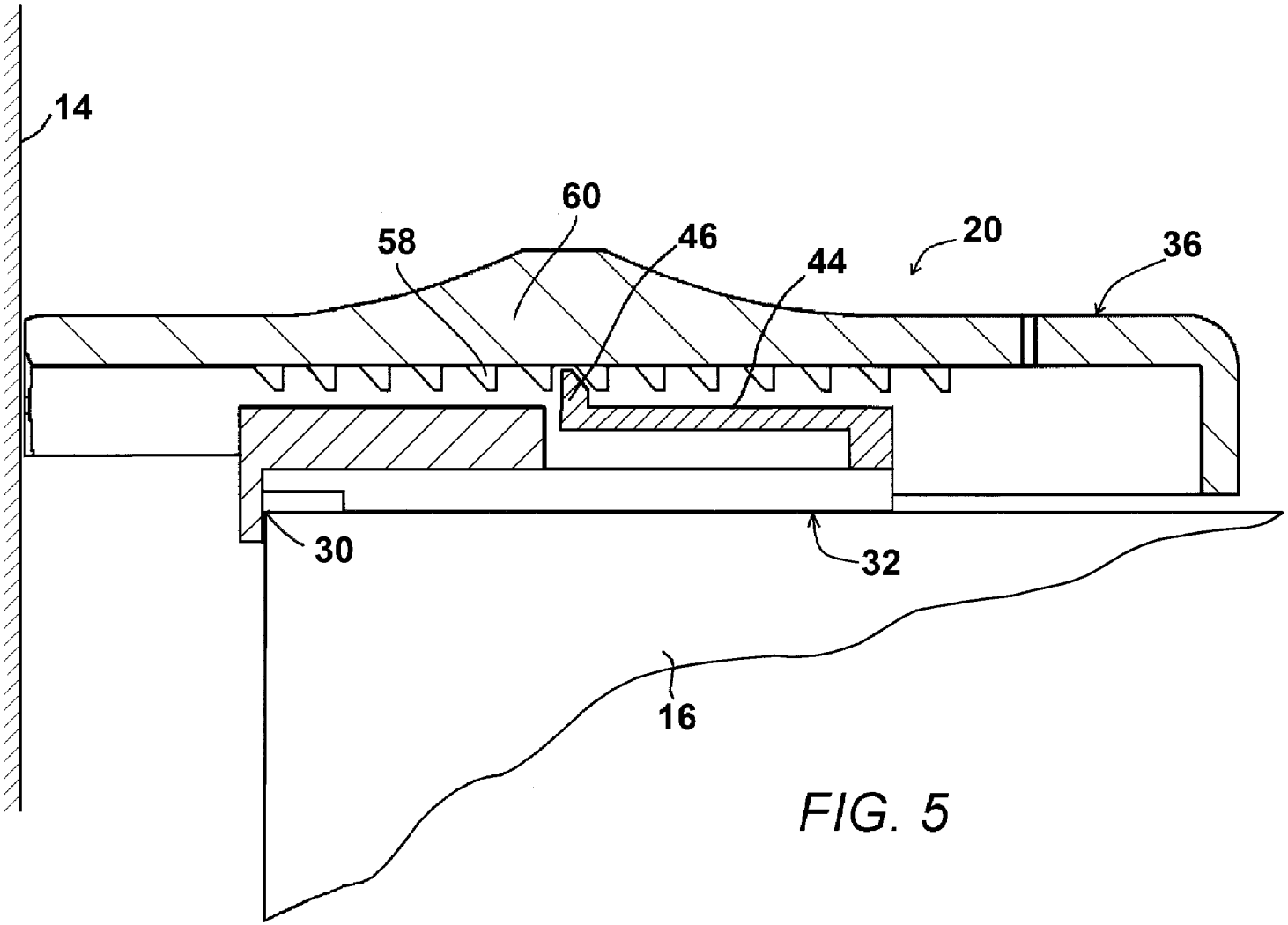
FIG. 5 is a cross-sectional view of the spacer assembly of FIGS. 3 and 4.

Referring to FIG. 5 in conjunction with FIGS. 3 and 4, it can be seen that when the base 32 is mounted to a sash 16, the catch 46 on the flexible finger 44 faces upwardly. The slide 36 is connected to the base 32 by advancing the T-shaped base 32 into the T-shaped slot 56 defined by the slide 36. Once interconnected, the catch 46 on the flexible finger 44 engages the racks of teeth 58 within the slide 36. The intermeshing of the catch 46 with the racks of teeth 58 prevents the slide 36 from inadvertently moving laterally with respect to the base 32.

To adjust the position of the slide 36, a manual force is applied downwardly to the press plate 60 on the slide 36. The press plate 60 contacts the catch 46 on the flexible finger 44 of the base 32 and moves the catch 46 downwardly. Once depressed, the catch 46 no longer engages the racks of teeth 58 and the slide 36 is free to move laterally.

To utilize the system, the base 32 of two spacer assemblies 20 is mounted to the top corners 30 of a window sash 16. Slides 36 are then attached to the base 32. The window sash 16 is then assembled or otherwise positioned into a window frame. The slide 36 is extended until the slide 36 either touches or is in very close proximity to the side jambs 14 of the window frame 12. The window assembly 10 is then free to operate in its normal manner. If uneven forces are applied to the window sash 16, the presence of the spacer assemblies 20 prevents the window sash 16 from cocking in position within the window frame 12.

If the window sash 16 is to be tilted in or removed, the slide 36 is adjusted inwardly so that the spacer assembly 20 is at its shortest length. The window sash 16 can then be tilted or removed in a conventional manner.

The spacer assembly 20 is an assembly that can be selectively adjusted in length. The range of adjustability is preferably at least $3/8^{ths}$ of an inch. It will be understood that there are many assemblies that can be adjusted in length in this range. One such alternate embodiment is shown in FIG. 6.

Figure 6:
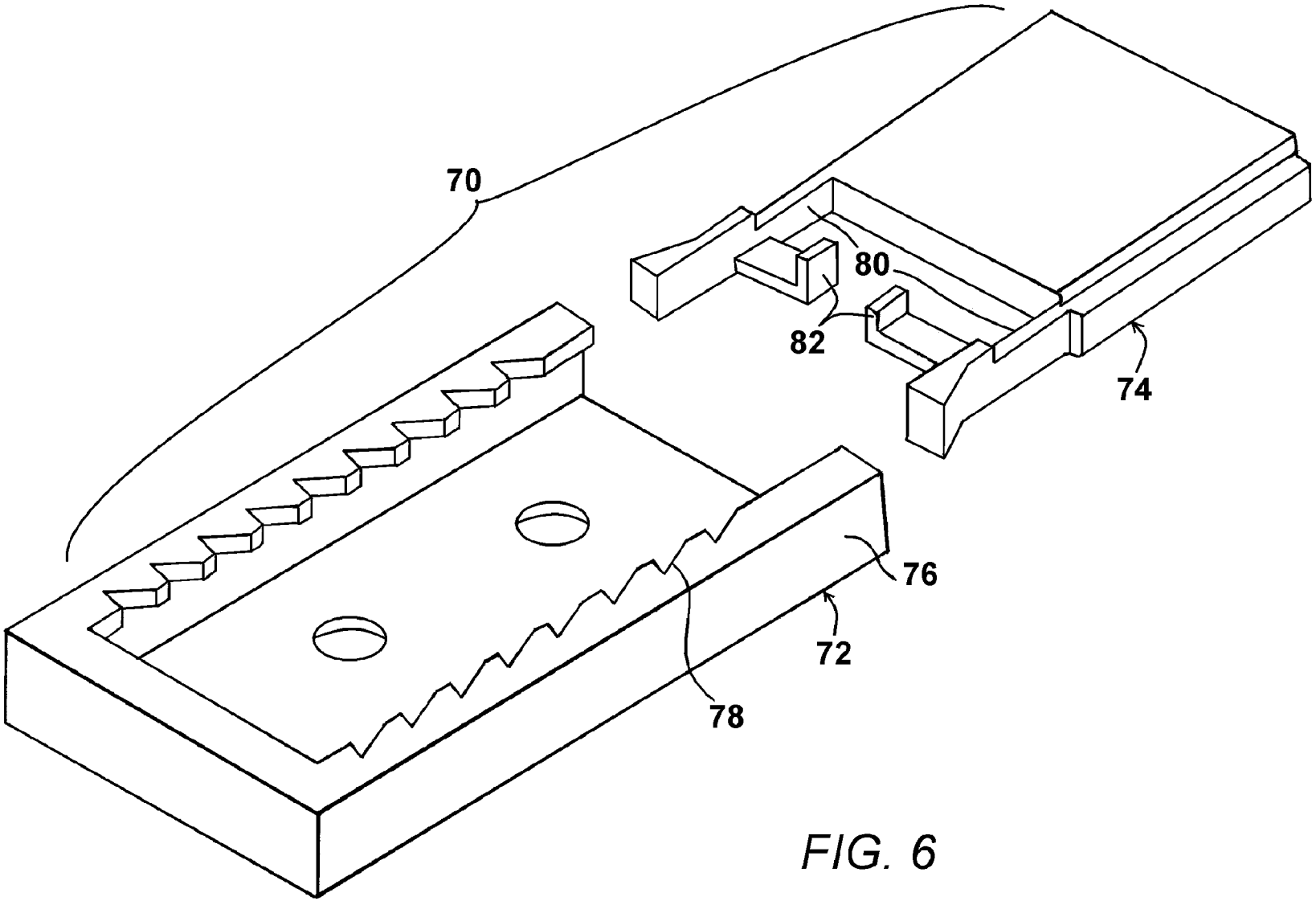
FIG. 6 is a perspective view of a second embodiment of a spacer assembly.

Referring to FIG. 6, a spacer assembly 70 is shown having a base 72 and a slide 74. In the shown embodiment, the base 72 is generally U-shaped having sidewalls 76. Teeth 78 are formed along the length of the sidewalls 76. The base 72 is attached to a sash using a screw or similar fastener.

The slide 74 fits within the base 72. The slide 74 has two flexible fingers 80 that engage the teeth 78 on the sidewalls 76 of the base 72 and lock the slide 74 in position. Two tabs 82 are provided for manually deflecting the flexible fingers 80. When the tabs 82 are pressed toward each other, the locking fingers disengage the base 72 and the slide 74 is free to reciprocally move within the base 72. Accordingly, the slide 74 can be adjusted to any position within the confines of the base 72.

It will be understood that the embodiments of the present invention that are described and illustrated are merely exemplary and that a person skilled in the art can make many variations to those embodiments using functionally equivalent components. For instance, the spacer assembly can have many configurations other than have been illustrated. What is of importance is that the slide assemblies have a base that can be attached to a sash and that the spacers have an adjustable element that can be extended and retracted as needed. All such variations, modifications, and alternate embodiments are intended to be included within the scope of the present invention as defined by the claims.

What is claimed is:

1. A window construction, comprising:

a window frame having side jambs;

at least one window sash set within said side jambs of said frame, said window sash having at least one pane of glass supported between a top sash element, a bottom sash element and two side sash elements, wherein a gap space exists between each of said side sash elements and a respective one of said side jambs;

a base mounted to said top sash element, said base having an upwardly oriented catch that is supported by a flexible finger; and a slide that engages said base and is selectively moveable along said base, said slide having downwardly oriented teeth, wherein some of said downwardly oriented teeth are engaged by said upwardly oriented catch on said base to prevent said movement of said slide along said base, said slide further including a press plate formed into said slide, said press plate that engages said catch when manually depressed causing said flexible finger to deflect and said upwardly oriented catch to disengage from said downwardly oriented teeth and enable said slide to move along said base and selectively span a respective one of said gap spaces to prevent said window sash from cocking within said window frame; and wherein said base and said slide combine to form a spacer assembly.

2. The window construction according to claim 1, wherein said base engages a corner of said window sash.

3. The window construction according to claim 2, wherein said base has a bottom surface that rests upon said top sash element and a stop.

4. The window construction according to claim 1, wherein said spacer assembly has a maximum height no greater than ¼ inch.

5. A window sash, comprising;

a sash framework containing a top sash element, a bottom sash element and at least two side sash elements;

at least one pane of glass supported by said sash framework; and a spacer mounted to said top sash element, said spacer having a base and a slide that engages said base, said base having an upwardly oriented catch that is supported by a flexible finger, said slide being selectively moveable along said base, wherein said slide has downwardly oriented teeth, wherein some of said teeth are engaged by said upwardly oriented catch on said base to prevent said movement of said slide along said base;

said slide further including a press plate formed into said slide, said press plate engages said catch when manually depressed causing said flexible finger to deflect and said upwardly oriented catch to disengage from said downwardly oriented teeth and enable said slide to move along said base, wherein said slide is selectively extendable from said base a distance beyond said top sash element.

6. The window sash according to claim 5, wherein said downwardly oriented teeth are spaced apart a predetermined increment.

7. The window sash according to claim 5, wherein said sash framework has a corner and said base engages said corner.

8. The window sash according to claim 7, wherein said base has a bottom surface that rests upon said top sash element and a stop that engages one of said side sash elements.

9. The window sash according to claim 5, wherein said spacer has a maximum height no greater than ¼ inch.

* * * * *